US012390066B2

(12) United States Patent
Li et al.

(10) Patent No.: US 12,390,066 B2
(45) Date of Patent: Aug. 19, 2025

(54) SMART CLEANING SYSTEM, AUTONOMOUS ROBOT, AND DOCK STATION

(71) Applicant: Beijing Roborock Technology Co., Ltd., Beijing (CN)

(72) Inventors: Xing Li, Beijing (CN); Yongfei Zhou, Beijing (CN); Chuanlin Duan, Beijing (CN)

(73) Assignee: Beijing Roborock Technology Co., Ltd., Beijing (CN)

( * ) Notice: Subject to any disclaimer, the term of this patent is extended or adjusted under 35 U.S.C. 154(b) by 280 days.

(21) Appl. No.: 17/599,802

(22) PCT Filed: May 13, 2020

(86) PCT No.: PCT/CN2020/090085

§ 371 (c)(1),
(2) Date: Sep. 29, 2021

(87) PCT Pub. No.: WO2020/200328

PCT Pub. Date: Oct. 8, 2020

(65) Prior Publication Data

US 2022/0175206 A1 Jun. 9, 2022

(30) Foreign Application Priority Data

Mar. 29, 2019 (CN) ..... 201910250476.3

(51) Int. Cl.
*A47L 9/14* (2006.01)
*A47L 9/12* (2006.01)
(Continued)

(52) U.S. Cl.
CPC ..... *A47L 9/149* (2013.01); *A47L 9/12* (2013.01); *A47L 9/20* (2013.01); *A47L 9/248* (2013.01);
(Continued)

(58) Field of Classification Search
USPC ..... 15/339
See application file for complete search history.

(56) References Cited

U.S. PATENT DOCUMENTS 5,444,893 A * 8/1995 Hwang ..... G01F 1/66 15/325
7,966,691 B2 * 6/2011 Takahashi ..... A47L 9/2821 15/352
(Continued)

FOREIGN PATENT DOCUMENTS

CN 102334943 A 2/2012
CN 102652654 A 9/2012
(Continued)

OTHER PUBLICATIONS

International Search Report issued in corresponding International Patent Application No. PCT/CN2020/090085 dated Aug. 14, 2020.
(Continued)

*Primary Examiner* — Edward F Landrum
*Assistant Examiner* — Dana Lee Poon
(74) *Attorney, Agent, or Firm* — Morgan, Lewis & Bockius LLP

(57) ABSTRACT

The present disclosure provides an autonomous robot, configured to perform a cleaning function and an emptying function.

16 Claims, 10 Drawing Sheets

(51) Int. Cl.

| | |
|---|---|
| ***A47L 9/20*** | (2006.01) |
| ***A47L 9/24*** | (2006.01) |
| ***A47L 9/28*** | (2006.01) |
| ***A47L 11/28*** | (2006.01) |
| ***A47L 11/40*** | (2006.01) |

(52) U.S. Cl.
CPC ..... *A47L 9/2836* (2013.01); *A47L 11/28* (2013.01); *A47L 11/4091* (2013.01); *A47L 2201/024* (2013.01)

(56) References Cited

U.S. PATENT DOCUMENTS

| | | | | |
|---|---|---|---|---|
| 11,006,806 | B2 * | 5/2021 | Cargill | B01D 46/446 |
| 2006/0185690 | A1 * | 8/2006 | Song | A47L 11/34 134/21 |
| 2009/0044370 | A1 * | 2/2009 | Won | A47L 11/4008 15/319 |
| 2009/0049640 | A1 * | 2/2009 | Lee | A47L 9/20 901/1 |
| 2012/0011676 | A1 * | 1/2012 | Jung | A47L 9/30 15/301 |
| 2016/0183752 | A1 * | 6/2016 | Morin | A47L 9/2842 15/340.1 |
| 2017/0196430 | A1 * | 7/2017 | Machida | A47L 7/0047 |
| 2018/0064303 | A1 * | 3/2018 | Meggle | A47L 9/1409 |
| 2021/0030248 | A1 * | 2/2021 | Ko | A47L 11/4083 |

FOREIGN PATENT DOCUMENTS

| | | | |
|---|---|---|---|
| CN | 204305368 | U | 4/2015 |
| CN | 105640440 | A | 6/2016 |
| CN | 105848549 | A | 8/2016 |
| CN | 107405033 | A | 11/2017 |
| CN | 206612752 | U | 11/2017 |
| CN | 107529930 | A | 1/2018 |
| CN | 107595207 | A | 1/2018 |
| CN | 108403017 | A | 8/2018 |
| CN | 109316135 | A | 2/2019 |
| CN | 109480713 | A | 3/2019 |
| CN | 109480714 | A | 3/2019 |
| CN | 209899274 | U | 1/2020 |
| DE | 102016119103 | A1 | 4/2018 |
| KR | 20150066329 | A | 6/2015 |

OTHER PUBLICATIONS

Notice of Allowance issued in the corresponding CN Application No. 201910250476.3, mailed Apr. 26, 2024.

* cited by examiner

SMART CLEANING SYSTEM, AUTONOMOUS ROBOT, AND DOCK STATION

CROSS-REFERENCES TO RELATED APPLICATIONS

This application is the 371 application of PCT Application No. PCT/CN2020/090085, filed May 13, 2020, which claims priority to the Chinese patent application No. 201910250476.3 filed on Mar. 29, 2019, the content of both of which is incorporated herein as a part of the disclosure by reference.

TECHNICAL FIELD

The disclosure generally relates to the field of cleaning tools and, more particularly, to an intelligent cleaning system with a garbage recycling function, an autonomous robot, and a dock station.

BACKGROUND

A general sweeping robot is equipped with a dust box for storing garbage. After the dust box is filled with the garbage, a user needs to manually take out the dust box, clean up the garbage in the dust box, and then put the dust box into the sweeping robot. If the dust box is full of garbage and is not cleaned up in time, the dust box will affect the cleaning ability of the sweeping robot. Generally, the sweeping robot has a small size, and the dust box has a correspondingly small volume. Therefore, the volume of the garbage that can be contained by the dust box is limited, and the dust box is easily filled up. Therefore, in daily use, the user needs to manually clean the dust box full of garbage frequently, which seriously affects the user's experience. For example, when cleaning a large area, the dust box may be full before the cleaning is completed. At this time, if there is no user intervention (cleaning the dust box), the sweeping robot either does not continue to clean, or continues to clean but the cleaning effect becomes poor.

Therefore, it is necessary to provide an intelligent cleaning system with a garbage recycling function, an autonomous robot, and a dock station to at least partially solve the foregoing problems.

It should be noted that information disclosed in the background above is only used to enhance the understanding of the background of the disclosure, and therefore may include information that does not constitute the prior art known to a person skilled in the art.

SUMMARY

A series of simplified concepts is introduced in the summary section, and described in further detail in the section on embodiments. The content in the summary does not intend to limit the key features and necessary technical features of the claimed technical solution, nor does it intend to be used for determining the protection scope of the claimed technical solution.

In order to at least partially solve the foregoing technical problems, according to a first aspect of the disclosure, there is provided an intelligent cleaning system, including:

an autonomous robot, configured to perform a cleaning function and an emptying function, including:

a first receiving part, configured to receive an object collected by the autonomous robot when performing the cleaning function;

a first air duct, pneumatically connected with the first receiving part; and a suction device, configured to be capable of generating an airflow with a suction effect through the first receiving part and capable of being openly and closably pneumatically connected with the first receiving part via the first air duct; and a dock station, configured to be docked by the autonomous robot to empty and collect the object from the first receiving part, including:

a second receiving part, configured to receive the object emptied from the first receiving part;

a second air duct, pneumatically connected with the second receiving part and configured to allow the object to enter the second receiving part along with the airflow; and a third air duct, pneumatically connected with the second receiving part and configured to allow the airflow to flow out of the second receiving part.

The intelligent cleaning system is configured to cut off the first air duct in a state when the autonomous robot is docked with the dock station to perform the emptying function. The first receiving part is pneumatically connected with the suction device via the second air duct, the second receiving part, and the third air duct.

According to a second aspect of the disclosure, there is also provided an autonomous robot. The autonomous robot is configured to perform a cleaning function and an emptying function and includes:

a first receiving part, configured to receive an object collected by the autonomous robot when performing the cleaning function, and capable of being openly and closably pneumatically connected with the outside via an emptying exit;

a first air duct, pneumatically connected with the first receiving part; and a suction device, configured to be capable of generating an airflow with a suction effect through the first receiving part, capable of being openly and closably pneumatically connected with the first receiving part via the first air duct, and capable of being openly and closably pneumatically connected with the outside via an air return inlet.

In a state when the autonomous robot performs the cleaning function, the first air duct is in an open state and the emptying exit and the air return inlet are in a closed state. In a state when the autonomous robot performs the emptying function, the first air duct is in a closed state and the emptying exit and the air return inlet are in an open state.

According to a third aspect of the disclosure, there is also provided a dock station. The dock station is configured to be docked by any of the foregoing autonomous robots to empty and collect an object from the autonomous robot, and includes:

a second receiving part, configured to receive the object emptied from the autonomous robot;

a second air duct, pneumatically connected with the second receiving part and configured to allow the object to enter the second receiving part along with an airflow; and a third air duct, pneumatically connected with the second receiving part and configured to allow the airflow to flow out of the second receiving part.

When the autonomous robot is docked with the dock station, the second air duct is pneumatically connected with the first receiving part via an emptying exit. The third air duct is pneumatically connected with the suction device via the air return inlet.

BRIEF DESCRIPTION OF THE DIAGRAMS

In order to make the advantages of the disclosure easier to understand, the disclosure briefly described above is described in more detail by referring to specific embodiments shown in the drawings. It may be understood that these drawings depict only typical implementations of the disclosure, and therefore should not be considered as limiting the protection scope thereof, and the disclosure is described and explained with additional characteristics and details through the drawings.

DESCRIPTION OF THE INVENTION

In the following discussion, details are given in order to provide a more thorough understanding of the disclosure. However, a person skilled in the art may understand that the disclosure may be implemented without one or more of these details. In certain examples, to avoid confusion with the disclosure, a plurality of technical features known in the art are not described in detail.

Figure 1:
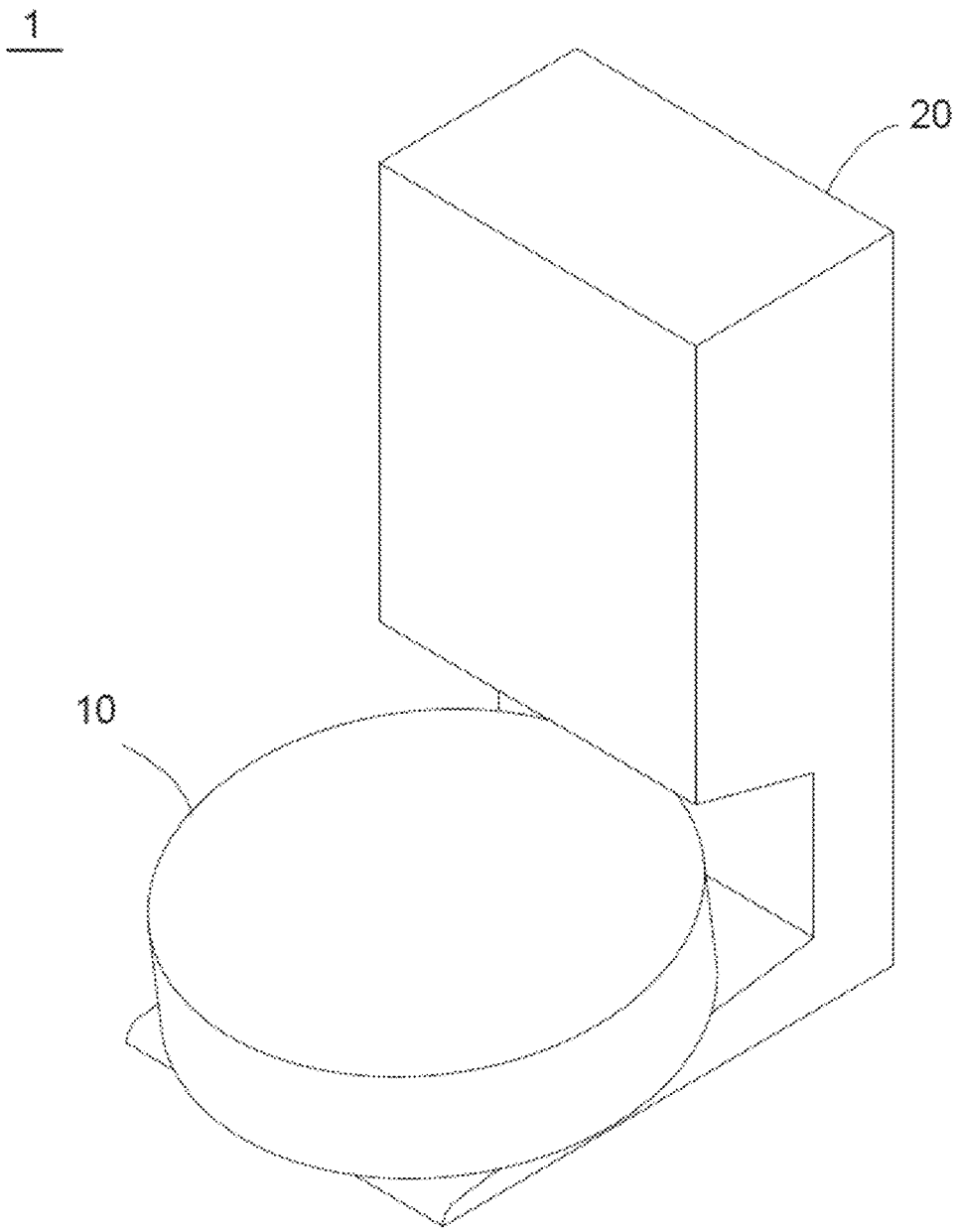
FIG. 1 is a schematic diagram of an intelligent cleaning system according to an embodiment of the disclosure.

FIG. 1 shows an intelligent cleaning system 1 including an autonomous robot 10 and a dock station 20 according to the disclosure. The autonomous robot 10 is configured to be capable of moving autonomously on the ground to perform a cleaning function. The autonomous robot 10 is also configured to be capable of autonomously moving to the dock station 20 to be docked with the dock station 20 (as shown in the state shown in FIG. 1) to empty the object collected during the cleaning function. The object may include garbage such as paper scraps, dust, hair and the like.

It may be understood that the cleaning function of the autonomous robot 10 may include at least one function of sweeping a floor and mopping a floor. In some embodiments, the autonomous robot 10 is a cleaning robot that integrates sweeping and mopping functions. The autonomous robot 10 mainly includes a cleaning unit, a sensing unit, a control unit, a driving unit, an energy unit, and a man-machine interaction unit. The various units coordinate and cooperate with each other so that the autonomous robot 10 may move autonomously to realize the cleaning function.

Figure 2:
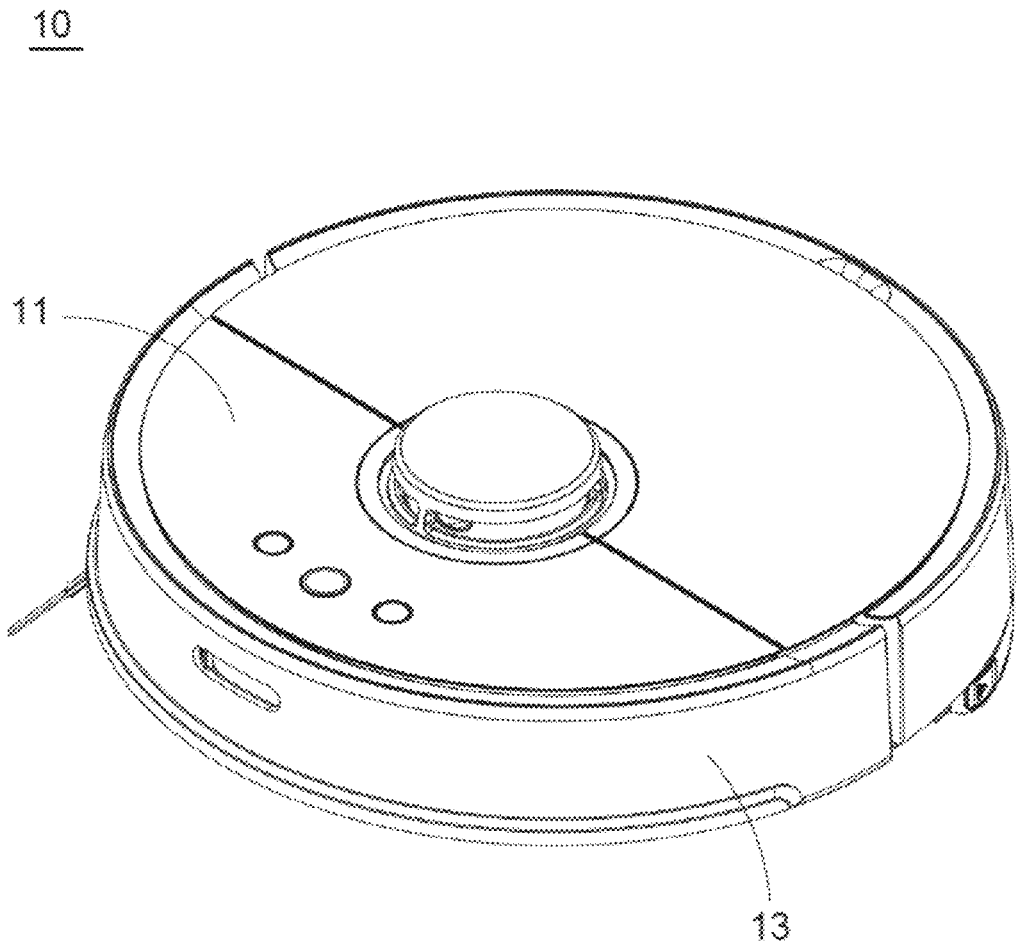
FIG. 2 is a perspective view of an autonomous robot according to an embodiment of the disclosure.
Figure 3:
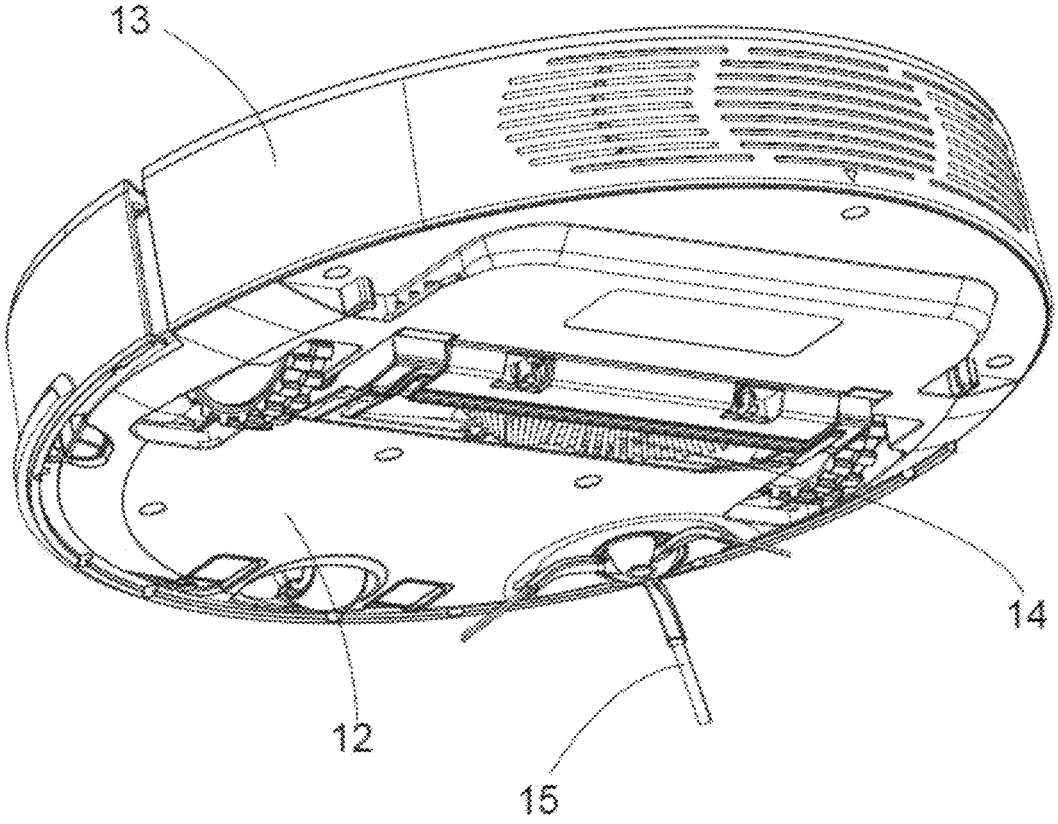
FIG. 3 is a perspective view of the autonomous robot shown in FIG. 2 from another view.

FIGS. 2 and 3 exemplarily show a perspective view of the autonomous robot 10 according to the disclosure. Viewed from the outside, the autonomous robot 10 has an approximately circular shape (the front and the rear thereof are circular) and includes an upper cover 11, a chassis 12, and a middle frame 13 arranged between the upper cover 11 and the chassis 12. The middle frame 13 serves as a basic frame for providing various functional elements. The upper cover 11 and the chassis 12 cover the upper and lower surfaces of the middle frame 13, respectively, to protect internal parts and improve the aesthetics of the autonomous robot 10. In some other embodiments, a main body of the robot may also have other shapes, including but not limited to an approximate D-shape with its front being half-rectangle and back being half-circle.

The driving unit is configured to provide a driving force for the autonomous movement of the autonomous robot 10 and for the cleaning function of the cleaning unit. The autonomous robot 10 perceives an external environment such as a terrain with the sensing unit, and the sensing unit provides the control unit with various position information and motion state information of the robot. The control unit comprehensively determines a current working state (for example, crossing a threshold; moving on a carpet; positioned on, above or below a cliff; being stuck; having a full dust box; being picked up) of the autonomous robot 10 based on such information and gives a next-action strategy for different situations. Further, the control unit may plan the most efficient and reasonable cleaning path and cleaning mode based on real-time map information, which greatly improves the working efficiency of the autonomous robot 10. The man-machine interaction unit enables the user to select a function and/or shows the user a current state or a function selection item of the robot. The energy unit is configured to provide electrical energy for functional elements of the various units.

The cleaning unit is the most important core unit of the autonomous robot 10, configured to realize the cleaning function, and includes a dry cleaning part and a wet cleaning part. The dry cleaning part is mainly configured to clean and collect the object on the cleaned surface, such as solid particle contaminants, and the wet cleaning part is mainly configured to wipe the cleaned surface (such as the floor).

Specifically, the dry cleaning part mainly includes a cleaning brush for picking up an object from the surface to be cleaned, a first receiving part for collecting and receiving the object, and a suction device. As shown in FIG. 3, the cleaning brush includes a main brush 14 and a side brush 15. The main brush 14 has a rotation shaft substantially parallel to a plane where the chassis 12 is arranged, and protrudes outward from the chassis 12. As a result, bristles or blades of the main brush 14 form a certain interference with the cleaned surface under the chassis 12. The side brush 15 is arranged at a bottom edge. A rotation shaft of the side brush is at a certain angle with respect to the floor, so as to move the object to the cleaned area of the main brush 14.

Figure 4:
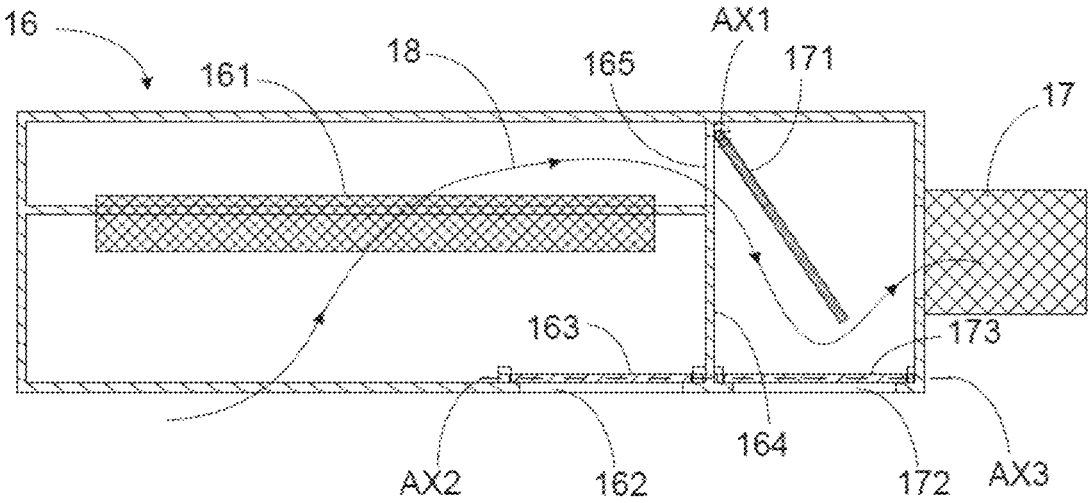
FIG. 4 is a schematic structural diagram of a first receiving part and the suction device shown in FIG. 2.

The first receiving part and the suction device are arranged inside the autonomous robot 10. FIG. 4 schematically shows the structures of the first receiving part 16 and the suction device 17. The suction device 17 may be pneumatically connected with the first receiving part 16 via the first air duct 18 and is configured to generate an airflow with a suction effect through the first receiving part 16. The first receiving part 16 has an inlet (not shown). When the main brush 14 rotates, the object on the surface to be cleaned is wound by the main brush 14 to a position close to the inlet of the first receiving part 16 and then collected and received in the first receiving part 16 under the action of the airflow generated by the suction device. The first receiving part 16 may be configured as a dust box detachably or fixedly provided inside the autonomous robot 10. The suction device 17 may be configured as an air blower. In addition, the first receiving part 16 may also be configured as a receiving cavity or the like provided inside the autonomous robot 10. The suction device 17 may also be configured as a suction fan with a drive motor or the like.

In some embodiments, a first filter device 161 may be provided in the first air duct 18 so that when the autonomous robot 10 performs the cleaning function, the object that enters the first receiving part 16 with the airflow remains in the first receiving part 16, and only clean air is allowed to flow into the suction device 17 along the first air duct 18, so as to avoid damage to the suction device 17 caused by particles and the like. The first filter device 161 may be configured as a high-efficiency particulate air filter (HEPA) or similar device. Further in some embodiments, a vibration device (not shown) attached to the first filter device 161 may also be provided. When the autonomous robot 10 performs the cleaning function, the vibration device drives the first filter device 161 to continuously vibrate so that the dust and particles attached to the first filter device 161 fall off under the action of the vibration, thereby keeping the first filter device 161 with little air resistance and increasing the force of the suction device 17.

The wet cleaning part mainly includes a liquid storage tank and a cleaning cloth. The liquid storage tank contains a cleaning liquid, and the cleaning cloth is detachably arranged on the liquid storage tank. After the dry cleaning part is cleaned, the liquid in the liquid storage tank of the wet cleaning cloth flows to the cleaning cloth, and the cleaning cloth wipes the surface that was cleaned by the cleaning device.

Generally, the autonomous robot 10 has a small size, which results in a very limited volume of the first receiving part 16 therein. During daily use, the first receiving part 16 may easily reach the state of being full of collected objects. In this state, the autonomous robot 10 is often configured to stop cleaning. Even if the autonomous robot 10 is forcibly ordered to continue the cleaning work, the cleaning effect deteriorates due to the inability to continue to collect the objects such as solid particle pollutants.

Therefore, the autonomous robot 10, according to the disclosure, is further configured to be capable of autonomously moving to the dock station 20 to be docked with it (as shown in FIG. 1) so as to empty the object collected during the cleaning function, thereby preventing deterioration of the cleaning function. For example, when the first receiving part 16 is filled with the object, a detection device in the autonomous robot 10 for detecting the filling state of the first receiving part 16 may send to the control unit a signal indicating that the first receiving part 16 is full. After receiving the signal, the control unit searches for the dock station 20, according to a navigation algorithm stored therein, and controls the autonomous robot 10 to autonomously move to the dock station 20 to be docked with it for the emptying function according to a constructed map, the position of the robot in the map, and indication signals sent by the sensing devices arranged on the autonomous robot 10 and the dock station 20.

Figure 5:
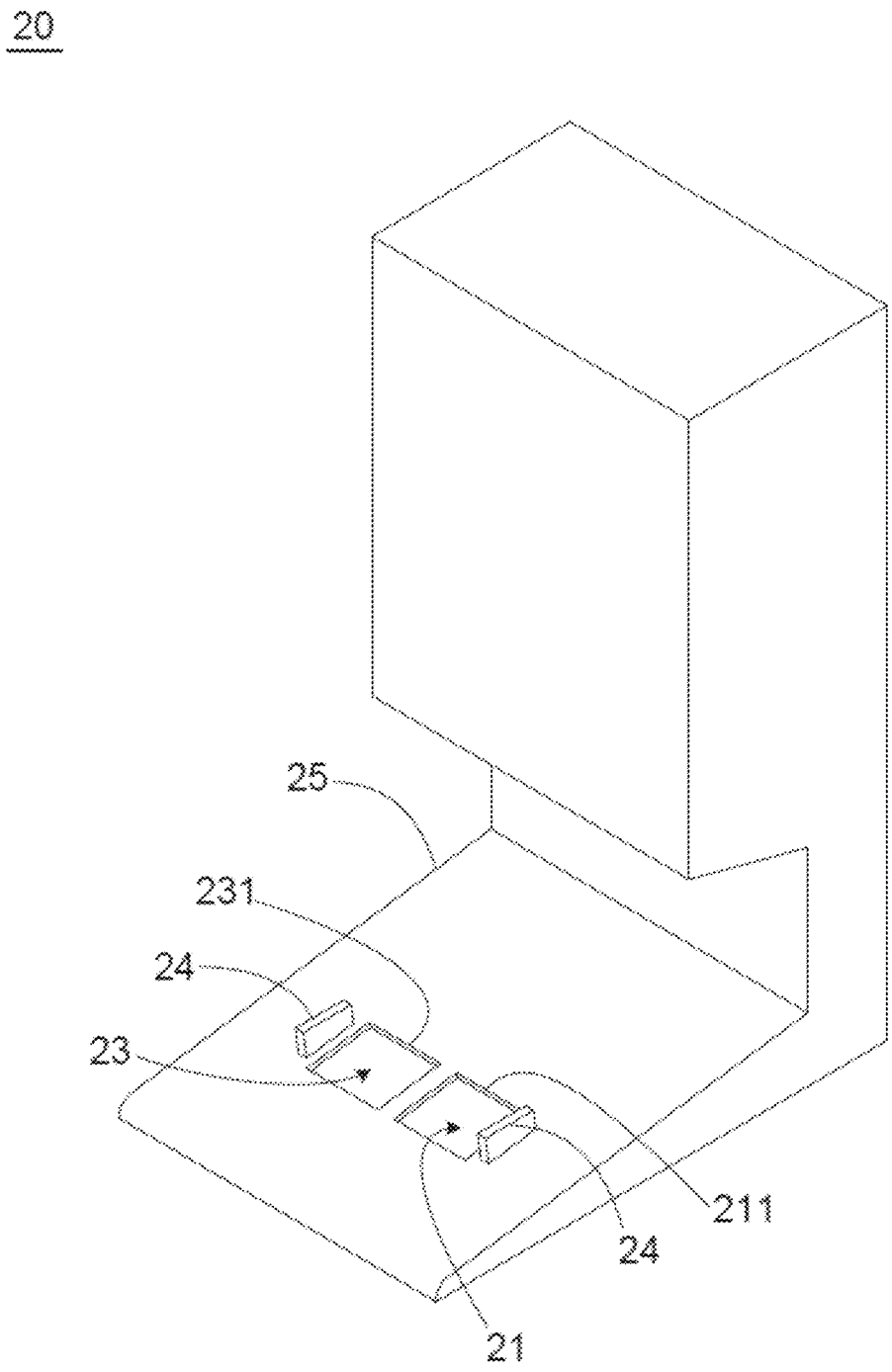
FIG. 5 is a perspective view of a dock station according to an embodiment of the disclosure.
Figure 6:
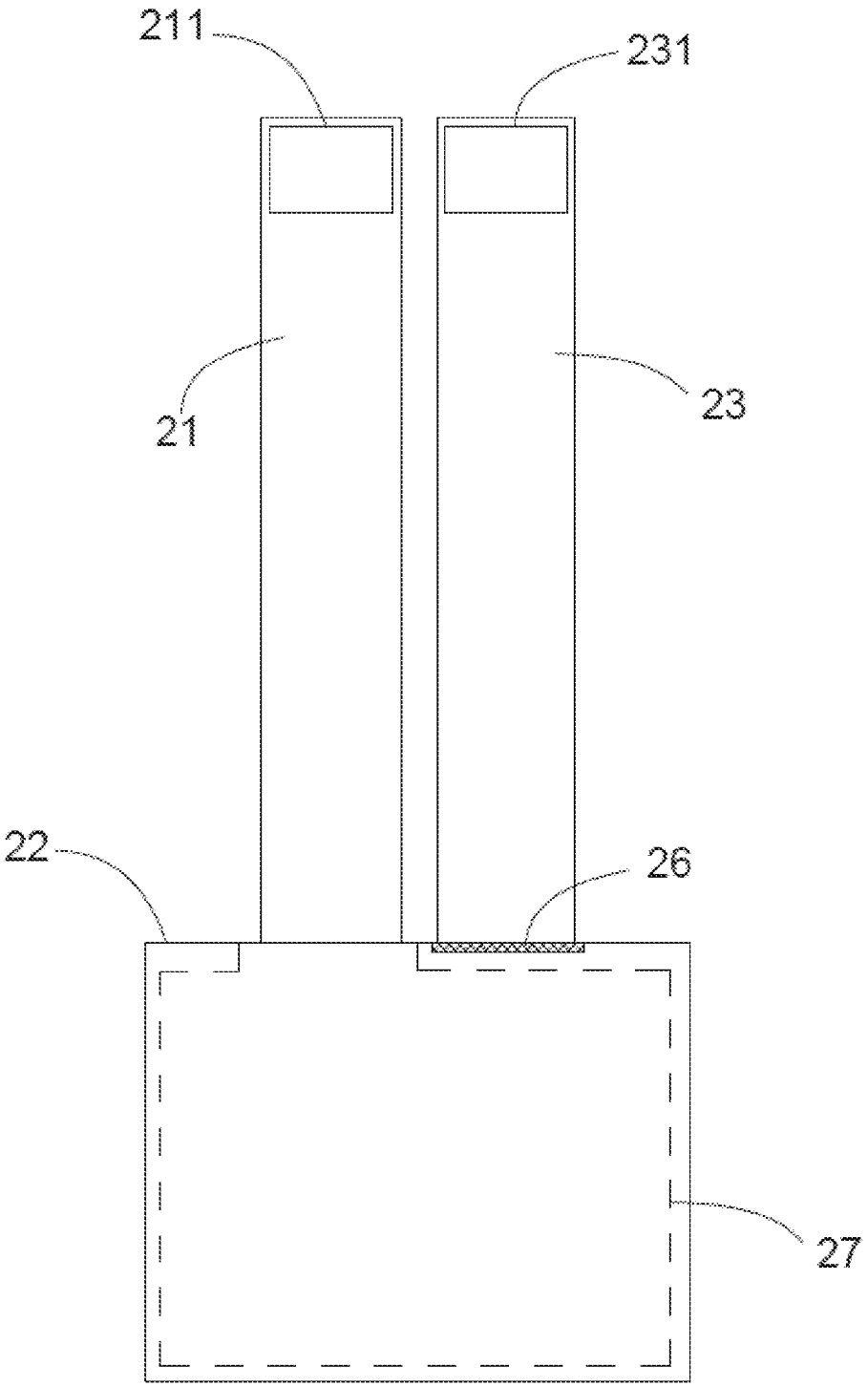
FIG. 6 is a schematic diagram of a second air duct, a second receiving part, and a third air duct of the dock station shown in FIG. 5.

FIGS. 5 and 6 schematically show the dock station 20 according to some embodiments of the disclosure. A second receiving part 22 is provided in the dock station 20. The volume of the second receiving part 22 may be designed to be much larger than that of the first receiving part 16. In addition, the dock station 20 is further provided with a second air duct 21 and a third air duct 23, which are pneumatically connected with the second receiving part 22, respectively. As shown in FIG. 5, the second air duct 21 forms an opening 211 of the second air duct 21 on the outer surface of the dock station 20, and the third air duct 23 forms an opening 231 of the third air duct 23 on the outer surface of the dock station 20.

Figure 7:
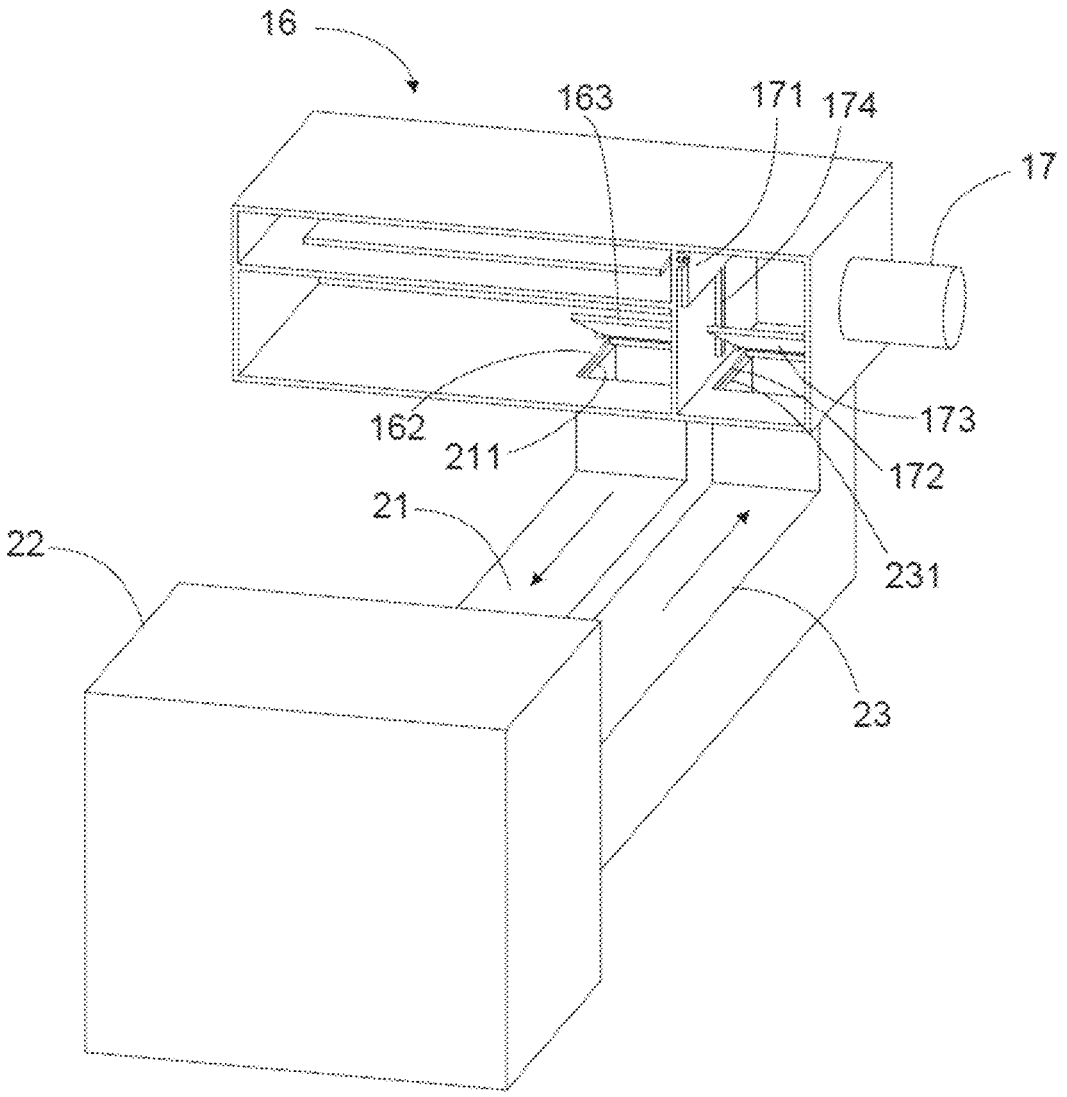
FIG. 7 is a schematic diagram of docking an autonomous robot with a dock station according to the disclosure.

Correspondingly, as shown in FIG. 4, the autonomous robot 10 is further provided with an emptying exit 162 and an air return inlet 172, which are not directly pneumatically connected with each other. The emptying exit 162 is pneumatically connected with the first receiving part 16, and the air return inlet 172 is pneumatically connected with the suction device 17. When the autonomous robot 10 is docked with the dock station 20 (as shown in FIG. 1), the emptying exit 162 of the autonomous robot 10, as shown in FIG. 7, is pneumatically connected with the opening 211 of the second air duct 21 of the dock station 20, and the air return inlet 172 of the autonomous robot 10 is pneumatically connected with the opening 231 of the third air duct 23 of the dock station 20. At this time, the first air duct 18 may be cut off so that the suction device 17 may be pneumatically connected with the first receiving part 16 only via the third air duct 23, the second receiving part 22, and the second air duct 21. In this state, the airflow with the suction effect generated by the suction device 17 sequentially flows from the first receiving part 16, the emptying exit 162, the opening 211 of the second air duct 21, the second air duct 21, the second receiving part 22, the third air duct 23, the opening 231 of the third air duct 23, and the air return inlet 172 to the suction device 17, thereby driving the object contained in the first receiving part 16 to be transferred into the second receiving part 22.

Although not shown in the drawings, a seal such as a sealing ring may be provided between the emptying exit 162 and the opening 211 of the second air duct 21, and between the air return inlet 172 and the opening 231 of the second air duct 21, so as to strengthen sealing performance and avoid leakage.

It may be understood that when the autonomous robot 10 performs the cleaning function, the emptying exit 162 needs to be kept in a closed state so as to prevent the object in the first receiving part 16 from leaking via the emptying exit 162 and hence causing recontamination of the cleaned surface. In addition, the air return inlet 172 needs to be kept in a closed state, while the first air duct 18 is in an open state, so as to ensure that a suction force generated by the suction device 17 completely acts on the first receiving part 16.

In addition, a flow path of the airflow generated by the suction device 17 when the autonomous robot 10 performs the cleaning function is smaller than that of the airflow when the autonomous robot 10 performs the emptying function. Therefore, in order to ensure sufficient suction, the autonomous robot 10 is configured such that the working power of the suction device 17 when the suction device 17 performs the emptying function is greater than that of the suction device 17 when the suction device 17 performs the cleaning function.

As shown in FIG. 6, a dust bag 27 may be provided in the dock station 20. The dust bag 27 is detachably arranged in the second receiving part 22 to facilitate the user to clean and replace the full dust bag 27. The dust bag 27 is pneumatically connected with the second air duct 21 to receive the object emptied from the first receiving part 16. The dust bag 27 itself may have a filtering function to keep the internal space of the dust bag 27 in pneumatical communication with the third air duct 23. In this way, after the airflow that carries the object passes through the dust bag 27, the object remains in the dust bag 27 and clean air flows along the third air duct 23 to the suction device 17.

In some other embodiments, the dust bag 27 may not be provided, and the second receiving part 22 may be provided as a receiving cavity or a dust box. A second filter device 26 is provided at a position where the second receiving part 22 is pneumatically connected with the third air duct 23 to retain the object in the second receiving part 22 and only allow the clean air to pass through. The second filter device 26 may have the same configuration as the first filter device 161.

In some embodiments, although not shown in the drawings, a one-way valve may be further provided in the second air duct 21 or between the second air duct 21 and the second receiving part 22. The one-way valve is configured to only open toward the airflow direction in the second air duct 21 shown in FIG. 7 (that is, open toward the second receiving part 22) and cannot be opened in a reverse direction. The one-way valve has a rotation axis extending substantially horizontally, which may be configured to be opened in response to the suction action of the suction device 17 and closed in response to gravity action after the suction device 17 stops working. In this way, when the emptying function is performed, the one-way valve is opened to allow the mixed flow of the object and the air to pass through. In other states, the one-way valve is closed to prevent the object of the second receiving part 22 from leaking via the second air duct 21.

After the first container 16 is emptied, the detection device sends a signal to the control unit indicating that the emptying is complete. If an unfinished cleaning task command is stored in the control unit at this time, the control unit controls the autonomous robot 10 to autonomously move to a position indicated by the cleaning task command after receiving the emptying completion signal, so as to perform the corresponding cleaning function. And if no unfinished cleaning task command is stored in the control unit at this time, the control unit may control the autonomous robot 10 to wait to receive another cleaning task command; for example, the control unit may be on standby, or autonomously move to a designated position to be standby. Alternatively, the autonomous robot 10 may be controlled to shut down directly at the current place or after autonomously moving to a designated position.

In some embodiments, the autonomous robot 10 may also be configured to automatically move to the dock station 20 to be docked with it at predetermined intervals to periodically perform the emptying function. In an embodiment, the dock station 20 may be a charging station for charging the autonomous robot 10. In this way, the autonomous robot 10 may also be configured to perform the emptying function every time when the autonomous robot 10 is charged.

It may be seen from the foregoing that, according to the intelligent cleaning system of the disclosure, the suction device 17 may be switched to be pneumatically connected with the first receiving part 16 via different air ducts to perform the cleaning function and the emptying function, respectively. In this way, only one suction device 17 needs to be provided in the autonomous robot 10, and no additional suction device is needed in the dock station 20, thereby saving costs, saving the mounting space of the dock station 20, and making its structure compact.

The switching of different air ducts pneumatically connected between the suction device 17 and the first receiving part 16 may be realized by an electronic element such as a solenoid valve controlled by the control unit according to a control program stored therein, or be realized by a linkage through simple mechanical means. In some embodiments, each air duct is opened and closed by the opening and closing of the valve.

As shown in FIG. 4, a substantially vertical wall 164 is provided between the suction device 17 and the first receiving part 16, and a ventilation opening 165 is provided on the wall 164. The ventilation opening 165 is configured as a part of the first air duct 18. A first valve 171 is further provided at a side of the wall 164 facing the suction device 17. The first valve 171 is able to rotate about a first axis AX1. The first axis AX1 is positioned above the ventilation opening 165 and extends in a substantially horizontal direction. In this way, when the suction device 17 stops working, the first valve 171 automatically abuts on the wall 164 to cover the ventilation opening 165 in response to the gravity action, thereby closing the first air duct 18. When the suction device 17 generates the airflow with the suction effect, the first valve 171 is pushed by the airflow to rotate upward about the first axis AX1 (as shown in FIG. 4), and the suction device 17 may be pneumatically connected with the first receiving part 16 via the ventilation opening 165. At this time, it may be considered that the first air duct 18 is in an open state.

Referring to FIG. 4, the autonomous robot 10 is provided with a second valve 163 at the emptying exit 162 to control the opening or closing of the emptying exit 162, and a third valve 173 at the air return inlet 172 to control the opening or closing of the air return inlet 172. Exemplarily, the second valve 163 is mounted inside the emptying exit 162 and may rotate about a second axis AX2. A plane where the emptying exit 162 is positioned is approximately horizontal. Therefore, the second valve 163 covers the emptying exit 162 to close the emptying exit 162 when only under the gravity action. In addition, the second valve 163 needs to overcome its gravity to be able to rotate around the second axis AX2 to open the emptying exit 162. When performing the cleaning function, although a suction force generated by the suction device 17 in the first receiving part 16 acts on the second valve 163, the suction force is not enough to overcome the gravity of the second valve 163. Therefore, it may be ensured that the emptying exit 162 maintains a closed state when the autonomous robot 10 performs the cleaning function and is not opened under the action of the suction device 17.

It may be understood that the plane where the emptying exit 162 is positioned may also be inclined with respect to a horizontal plane within a predetermined angle range, but an inclination angle should not be too large, so as not to make the gravity action too weak to open the second valve 163 in response to the action of the suction device 17. The air return inlet 172 and the third valve 173 may have the same structures as the emptying exit 162 and the second valve 163, which are not repeated here.

As shown in FIG. 5, a platform part 25 is provided on the dock station 20 and is configured to receive the autonomous robot 10 for docking. The platform part 25 has an upper surface inclined downward in a direction away from the dock station 20, which may facilitate guiding the autonomous robot 10 to move to the platform part 25 smoothly. The opening 211 of the second air duct 21 and the opening 231 of the third air duct 23 are both provided on the upper surface of the platform part 25.

In some embodiments, the upper surface of the platform portion 25 is provided with protrusions 24 at positions close to the opening 211 of the second air duct 21 and the opening 231 of the third air duct 23, respectively. When the autonomous robot 10 moves to the upper surface of the platform part 25 to complete the docking, one of the protrusions 24 may push the second valve 163 to rotate inwardly in response to the docked state of the autonomous robot 10 so that the emptying exit 162 is opened and aligned with the opening 211 of the second air duct 21 (as shown in FIG. 7), thereby realizing the communication between the first receiving part 16 and the second air duct 21. The third valve 173 is also opened in the same way.

In some embodiments, only one protrusion 24 can be provided corresponding to one of the second valve 163 and the third valve 173. The second valve 163 and the third valve 173 are provided as an integrally opening and closing structure. For example, the second valve 163 and the third valve 173 are configured as an integral structure or are formed separately and connected with each other using an additional connector to realize integral opening and closing. In this way, it is possible to avoid too many parts being arranged on the surface of the platform part 25.

In some embodiments, as shown in FIG. 7, an extension 174 extending downward is provided below the first valve 171. The positions of the first valve 171 and the third valve 173 can be reasonably arranged so that when the third valve 173 is opened, the third valve 173 abuts on the extension 174, thereby restricting the first valve 171 in the closed state, thereby realizing linkage. Therefore, by the limiting effect of the third valve 173 on the first valve 171, it is ensured that when the air return inlet 172 is opened, the first air duct 18 can be closed, thereby ensuring the smooth execution of the emptying function. It may be understood that during the docking process of the autonomous robot 10 with the dock station 20, the suction device 17 is in a state of stopping working, and at this time the first valve 171 is in a closed state in response to the gravity action. Therefore, the third valve 173 may be smoothly opened and limit the first valve 171, thereby avoiding a case that, when the third valve 173 is opened, the first valve 171 is in an open state and the third valve 173 cannot act on the extension 174 to limit the extension 174.

In addition, in some other embodiments the first valve and the third valve may also be arranged as an integrally opening and closing structure so that when the first valve is in an open state, the third valve can be in a closed state. When the first valve is in the closed state, the third valve can be in the open state.

Figure 8:
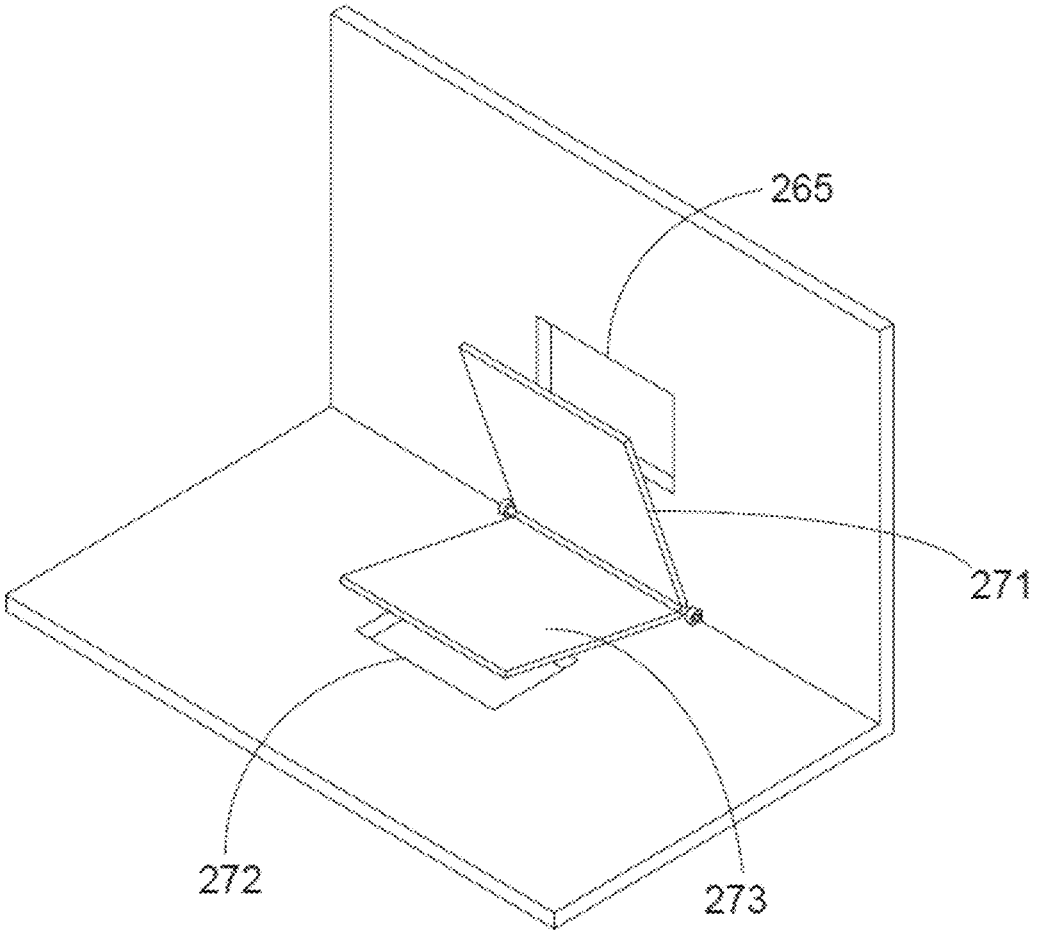
FIGS. 8-10 are schematic structural diagrams illustrating that a first valve and a third valve are integrally opened and closed in the autonomous robot shown in FIG. 2.
Figure 9:
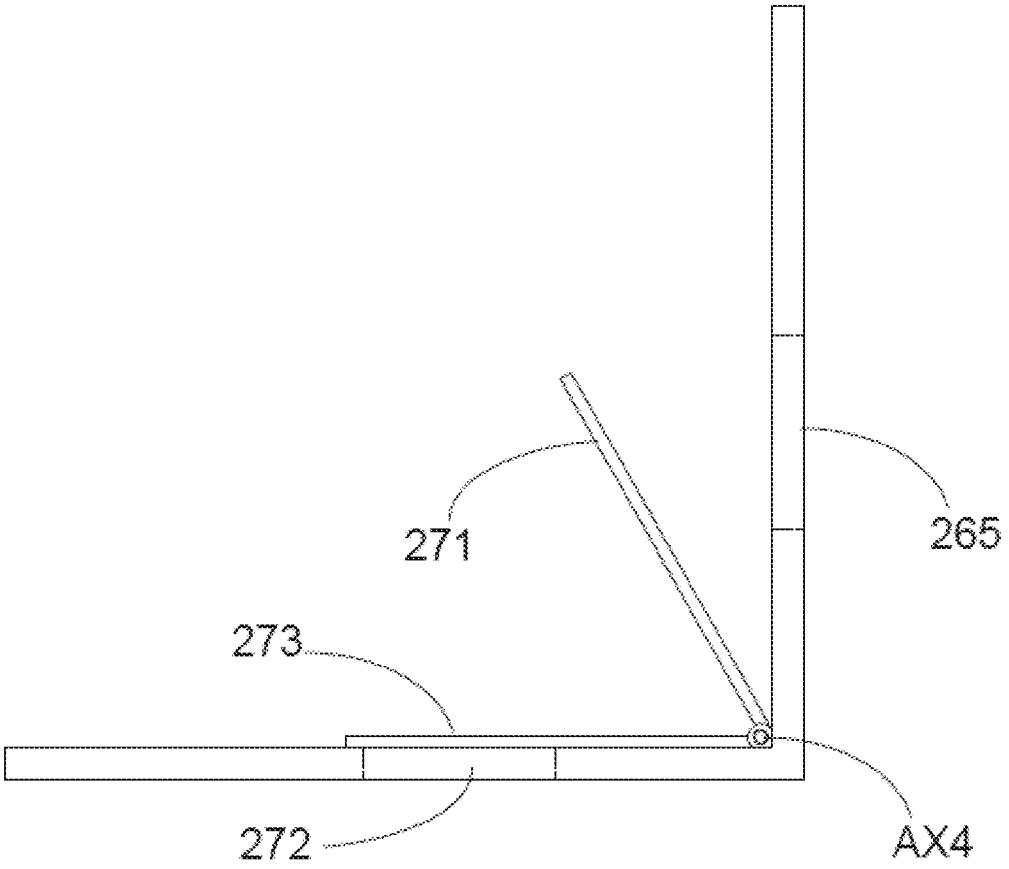
Figure 10:
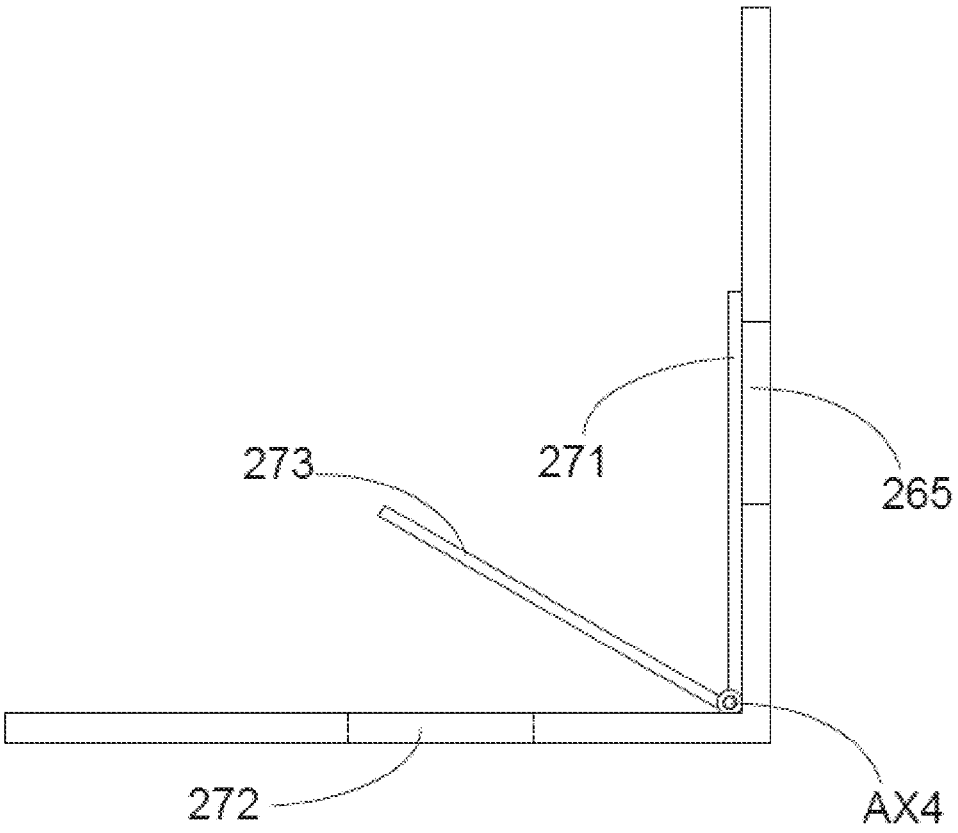

As shown in FIGS. 8-10, the first valve 271 and the third valve 273 are constructed as an integral structure. When performing the cleaning function, as shown in FIG. 9, the third valve 273 closes the air return inlet 272. At this time, the first valve 271 is away from the ventilation opening 265, and the first air duct remains unblocked. When performing the emptying function, as shown in FIG. 10, the third valve 273 rotates around a rotation axis AX4 to an open position under the action of the protrusion described above or other parts. At the same time, the first valve 271 rotates integrally with the third valve 273 from an open position to a closed position covering the ventilation opening 265. Such design can reduce the number of parts and improve the processing efficiency during the assembly of the apparatus. However, it should be noted that in such embodiments the first valve 271 cannot be opened in response to the suction action of the suction device, nor can it be closed in response to the gravity action, and it can only be opened and closed integrally with the third valve 273. In other words, when performing functions other than the emptying function, the third valve 273 maintains a normally closed state, and the first valve 271 maintains a normally open state.

In addition, in combination with the integrally opening and closing arrangement of the second valve and the third valve described above, the first valve, the second valve, and the third valve may also be integrated as a whole without violating the principle of the disclosure.

The intelligent cleaning system, the autonomous robot, and the dock station, according to the above embodiments of the disclosure, have the beneficial effects of any combination of the following.

1. The intelligent cleaning system is provided with the garbage recycling function, which may realize automatic garbage recycling without the user's intervention and improve user experience.

2. The cleaning function and the emptying function share one suction device, so there is no need to mount an additional suction device on the dock station, which saves costs and saves the mounting space of the dock station, thereby making its structure compact.

3. The first filter device of the autonomous robot is attached with the vibration device, which may clean the dust attached to the first filter device in time so as to keep the first filter device working under the minimum resistance condition, thereby improving the cleaning efficiency.

Unless otherwise specified, technical and scientific terms used herein have the same meanings as commonly understood by a person skilled in the art. The terms used herein are only for the objective of describing specific embodiments and are not intended to limit the disclosure. Terms such as "component" in this text may mean a single part or a combination of a plurality of parts.

Terms such as "mounting," "arranging" and the like in the disclosure may mean that one component is directly attached to another component, or that one component is attached to another component via an intermediate component. The features described in one embodiment herein may be applied to another embodiment alone or in combination with other features, unless the features are not applicable in the other embodiment or otherwise stated.

The disclosure has been described via the foregoing embodiments, but it should be understood that the foregoing embodiments are only for the objective of example and description and are not intended to limit the disclosure to the scope of the described embodiments.

What is claimed is:

1. An intelligent cleaning system, comprising:

an autonomous robot, configured to perform a cleaning function and an emptying function, comprising:

a first receiving part, configured to receive an object collected by the autonomous robot when performing the cleaning function;

a first air duct, pneumatically connected with the first receiving part; and a suction device, configured to generate airflow passing through the first receiving part, and be in a closable pneumatical connection with the first receiving part via the first air duct; and a dock station, configured to be docked by the autonomous robot to empty and collect the object from the first receiving part, the dock station comprising:

a second receiving part, configured to receive the object emptied from the first receiving part;

a second air duct, pneumatically connected with the second receiving part and configured to allow the object to enter the second receiving part along with the airflow; and a third air duct, pneumatically connected with the second receiving part and configured to allow the airflow to flow out of the second receiving part, wherein, in a state when the autonomous robot is docked with the dock station to perform the emptying function, the intelligent cleaning system is configured to close the first air duct, and the first receiving part is pneumatically connected with the suction device via the second air duct, the second receiving part, and the third air duct, wherein a working power of the suction device when the autonomous robot empties the object to the dock station during the emptying function is greater than another working power of the suction device when the autonomous robot collects the object from an to-be-cleaned surface during the cleaning function, wherein the autonomous robot is provided with an air return inlet pneumatically connected with the suction device;

wherein the autonomous robot is further provided with:

a first valve, configured to control the first air duct to open and close; and a third valve, configured to control the air return inlet to open and close;

wherein when the first valve is in an open state, the third valve is in a closed state; and when the third valve is in an open state, the first valve is in a closed state, and wherein the third valve, in the open state, is configured to limit movement of the first valve, causing the first valve to be locked in the closed state, and preventing the first air duct from being directly connected to the third air duct, wherein the first valve is provided with an extension part, and the first valve and the third valve are arranged in such a manner that, when the third valve is in the open state, the third valve abuts on the extension part, thereby restricting the first valve in the closed state.

2. The intelligent cleaning system according to claim 1, wherein the autonomous robot is provided with an emptying exit pneumatically connected with the first receiving part;

in the state when the autonomous robot is docked with the dock station, the second air duct is pneumatically connected with the first receiving part via the emptying exit, and the third air duct is pneumatically connected with the suction device via the air return inlet.

3. The intelligent cleaning system according to claim 2, wherein the autonomous robot is further provided with: a second valve, configured to control the emptying exit to open and close; wherein when the first valve is in the open state, the second valve is in a closed state; and when the second valve is in an open state, the first valve is in the closed state.

4. The intelligent cleaning system according to claim 3, wherein the first valve is configured to be, when the autonomous robot performs the cleaning function, switched from the closed state to the open state in response to suction action of the suction device, and switched from the open state to the closed state in response to gravity action when the suction device stops working.

5. The intelligent cleaning system according to claim 3, wherein the dock station is provided with a protrusion, and the protrusion is configured to, when the autonomous robot is docked with the dock station, push the second valve and the third valve to switch the second valve and the third valve from the closed state to the open state.

6. The intelligent cleaning system according to claim 3, wherein at least two of the first valve, the second valve, and the third valve are configured as an integral structure.

7. The intelligent cleaning system according to claim 1, wherein a first filter device is provided between the first receiving part and the suction device.

8. The intelligent cleaning system according to claim 7, wherein the autonomous robot further comprises a vibrating device and the vibrating device is attached to the first filter device and configured to drive the first filter device to vibrate when the autonomous robot performs the cleaning function.

9. The intelligent cleaning system according to claim 1, wherein a second filter device is provided between the second receiving part and the third air duct.

10. The intelligent cleaning system according to claim 1, wherein a one-way valve is provided in the second air duct or between the second air duct and the second receiving part, and the one-way valve is configured to be opened toward the second receiving part.

11. The intelligent cleaning system according to claim 10, wherein the one-way valve is configured to be switched from a closed state to an open state in response to suction action of the suction device and switched from the open state to the closed state in response to gravity action when the suction device stops working.

12. An autonomous robot, wherein the autonomous robot is configured to perform a cleaning function and an emptying function, and comprises:

a first receiving part, configured to receive an object collected by the autonomous robot when performing the cleaning function, and be in a closable pneumatical connection with a dock station via an emptying exit;

a first air duct, pneumatically connected with the first receiving part; and a suction device, configured to generate an airflow passing through the first receiving part, be in a closable pneumatical connection with the first receiving part via the first air duct, and be in a closable pneumatical connection with the dock station via an air return inlet;

wherein in a state when the autonomous robot performs the cleaning function, the first air duct is in an open state and the emptying exit and the air return inlet are in a closed state; and, in a state when the autonomous robot performs the emptying function, the first air duct is in a closed state and the emptying exit and the air return inlet are in an open state, wherein a working power of the suction device when the autonomous robot empties the object to the dock station during the emptying function is greater than another working power of the suction device when the autonomous robot collects the object from an to-be-cleaned surface during the cleaning function, wherein the autonomous robot is further provided with:

a first valve, configured to control the first air duct to open and close; and a third valve, configured to control the air return inlet to open and close;

wherein when the first valve is in an open state, the third valve is in a closed state; and when the third valve is in an open state, the first valve is in a closed state, and wherein the third valve, in the open state, is configured to limit movement of the first valve, causing the first valve to be locked in the closed state, and preventing the first air duct from being directly connected to the third air duct, wherein the first valve is provided with an extension part, and the first valve and the third valve are arranged in such a manner that, when the third valve is in the open state, the third valve abuts on the extension part, thereby restricting the first valve in the closed state.

13. The autonomous robot according to claim 12, further comprising:

a second valve, configured to control the emptying exit to open and close; wherein when the first valve is in the open state, the second valve is in a closed state; and when the second valve is in an open state, the first valve is in the closed state.

14. The autonomous robot according to claim 13, wherein the first valve is configured to be, when the autonomous robot performs the cleaning function, switched from the closed state to the open state in response to suction action of the suction device, and switched from the open state to the closed state in response to gravity action when the suction device stops working.

15. The autonomous robot according to claim 13, wherein at least two of the first valve, the second valve, and the third valve are configured as an integral structure.

16. The autonomous robot according to claim 12, wherein a first filter device is provided between the first receiving part and the suction device.

* * * * *